US011147995B2

(12) United States Patent
Smith et al.

(10) Patent No.: US 11,147,995 B2
(45) Date of Patent: Oct. 19, 2021

(54) HYDRO FIRE MITIGATION SYSTEM

(71) Applicant: WAVEGUARD CORPORATION, Lakewood, CO (US)

(72) Inventors: Michael H. Smith, Castle Rock, CO (US); Randy Lang, Anthem, AZ (US); Ken DiPaolo, Golden, CO (US)

(73) Assignee: Waveguard Corporation, Lakewood, CO (US)

( * ) Notice: Subject to any disclaimer, the term of this patent is extended or adjusted under 35 U.S.C. 154(b) by 0 days.

(21) Appl. No.: 16/030,266

(22) Filed: Jul. 9, 2018

(65) Prior Publication Data

US 2019/0001170 A1 Jan. 3, 2019

Related U.S. Application Data

(63) Continuation of application No. 14/993,162, filed on Jan. 12, 2016, now Pat. No. 10,016,643, which is a continuation-in-part of application No. 14/278,402, filed on May 15, 2014, now abandoned.

(60) Provisional application No. 61/823,637, filed on May 15, 2013.

(51) Int. Cl.

| | |
|---|---|
| ***A62C 35/60*** | (2006.01) |
| ***A62C 37/36*** | (2006.01) |
| ***A62C 3/02*** | (2006.01) |

(52) U.S. Cl.

CPC ..... *A62C 35/60* (2013.01); *A62C 3/0214* (2013.01); *A62C 37/36* (2013.01)

(58) Field of Classification Search

CPC ..... A62C 35/60; A62C 3/0214; A62C 37/36

See application file for complete search history.

(56) References Cited

U.S. PATENT DOCUMENTS

| | | | | |
|---|---|---|---|---|
| 3,583,490 | A | 6/1971 | McFadden | |
| 4,428,434 | A * | 1/1984 | Gelaude | A62C 3/00 137/624.11 |
| 5,125,458 | A | 6/1992 | Berman | |
| 5,165,482 | A * | 11/1992 | Smagac | A62C 3/0214 169/13 |
| 5,538,396 | A | 7/1996 | Meierhoefer | |
| 5,692,571 | A * | 12/1997 | Jackson | A62C 3/0214 169/16 |
| 5,732,511 | A | 3/1998 | Scott | |

(Continued)

FOREIGN PATENT DOCUMENTS

| | | |
|---|---|---|
| EP | 2075037 | 7/2009 |
| KR | 10-1157403 | 6/2012 |
| WO | WO 20041052466 | 6/2004 |

OTHER PUBLICATIONS

"Fire Sprinklers," Technical Fact Sheet No. 15, in "Homebuilder's Guide to Constructin in Wildfire Zones Technical Fact Sheet Series," FEMA P-737, 2008, 8 pages.

(Continued)

*Primary Examiner* — Qingzhang Zhou

(74) *Attorney, Agent, or Firm* — Sheridan Ross PC

(57) ABSTRACT

A hydro fire mitigation system is provided that is associated with a structure. The system employs a number of sensors that detect an oncoming fire, which directs a controller to initiate fluid flow through a number of sprinklers. The system is fully autonomous and does not require municipal water or power during use.

20 Claims, 7 Drawing Sheets

(56) References Cited

U.S. PATENT DOCUMENTS

| | | | | |
|---|---|---|---|---|
| 5,931,233 | A * | 8/1999 | La Bonte | A62C 2/08 169/5 |
| 6,167,971 | B1 | 1/2001 | Van Lingen | |
| 6,523,616 | B1 | 2/2003 | Wallace | |
| 6,772,562 | B1 | 8/2004 | Dadamo | |
| 6,840,457 | B2 | 1/2005 | Park et al. | |
| 6,964,379 | B2 | 11/2005 | Crowley | |
| 6,975,225 | B2 | 12/2005 | Privalov et al. | |
| 7,275,604 | B1 | 10/2007 | Wall | |
| 7,712,542 | B2 | 5/2010 | Munroe | |
| 7,828,069 | B2 | 11/2010 | Lee | |
| 7,909,111 | B1 | 3/2011 | Hinojosa et al. | |
| 10,016,643 | B2 * | 7/2018 | Smith | A62C 3/0214 |
| 2005/0126794 | A1 * | 6/2005 | Palmer | A62C 3/0271 169/16 |
| 2005/0199748 | A1 | 9/2005 | Heil et al. | |
| 2007/0044978 | A1 * | 3/2007 | Cohen | A01G 25/167 169/5 |
| 2007/0158083 | A1 | 7/2007 | Duncan | |
| 2008/0000649 | A1 | 1/2008 | Guirguis et al. | |
| 2008/0185159 | A1 | 8/2008 | Walsh | |
| 2009/0014187 | A1 | 1/2009 | Wagner | |
| 2010/0000743 | A1 | 1/2010 | Cohen | |
| 2010/0071917 | A1 * | 3/2010 | Lalouz | A62C 3/0292 169/60 |
| 2012/0018179 | A1 | 1/2012 | Munro | |
| 2012/0168185 | A1 | 7/2012 | Yount | |
| 2013/0062080 | A1 | 3/2013 | Tobin et al. | |
| 2013/0264074 | A1 * | 10/2013 | Lewis | A62C 37/36 169/46 |
| 2014/0338930 | A1 | 11/2014 | Smith et al. | |

OTHER PUBLICATIONS

Official Action for U.S. Appl. No. 14/278,402, dated Jul. 13, 2015 5 pages.

Official Action for U.S. Appl. No. 14/993,162, dated May 10, 2017 7 pages.

Official Action for U.S. Appl. No. 14/993,162, dated Sep. 26, 2017 10 pages.

Notice of Allowance for U.S. Appl. No. 14/993,162, dated Mar. 26, 2018 5 pages.

* cited by examiner

HYDRO FIRE MITIGATION SYSTEM

CROSS-REFERENCE TO RELATED APPLICATIONS

This application is a continuation of U.S. patent application Ser. No. 14/993,162, filed Jan. 12, 2016, now U.S. Pat. No. 10,016,643, which is a continuation-in-part of U.S. patent application Ser. No. 14/278,402, filed May 15, 2014, which claims the benefit of U.S. Provisional Patent Application Ser. No. 61/823,637, filed May 15, 2013, the entire disclosures of which are incorporated by reference herein.

FIELD OF THE INVENTION

Embodiments of the present invention are generally related to hydro fire mitigation systems installed on structures that help prevent fires from igniting the structure. Some embodiments also have the ability to distinguish fires that come close to or ignite the structure.

SUMMARY OF THE INVENTION

Lightning strikes, which hit trees, power lines, transmission towers, open ground, and careless or accidental human activities are the primary causes of wildfires that wreak havoc and cause major damage to houses, businesses and outdoor structures. A fire may not start immediately after a lightning strike and can smolder for a period of time before becoming a full-blown wildfire.

Most believe that an advancing line of flames associated with a wildfire destroys homes. But it is more common that embers generated by the wildfire that ignite vegetation, debris and flammable materials. Two factors affect the structure's ability to survive wildfires: 1) a fire resistant roofing material; and 2) the existence of a fire defensible zone.

Sprinklers, although commonly applied for protecting interior structure, is one of the newest technologies in wildfire control and fire protection. Unlike interior sprinkler systems, exterior sprinkler systems are not primarily intended to extinguish a fire, but instead function to mitigate a fire. Exterior sprinkler systems are used to wet specific areas, which render combustibles (buildings and surrounding landscape) much less likely to ignite from contact with embers and exposure to intense heat generated by a nearby fire. Exterior sprinklers are also designed to soak the surrounding landscape with water and fire retardant so that moisture is released into the air to lower the ambient temperature and increase the humidity of the immediate area, and provide the added protection against ignition of combustibles within the immediate area. These mitigating effects extend some distance above ground level which helps direct the advancing wildfire away from the structure or predetermined area. Thus external sprinkler systems are most effective when in continual operation before the fire arrives.

It is one aspect of embodiments of the present invention to provide a hydro fire mitigation system that employs external sprinklers. The contemplated sprinkler system is positioned at predetermined locations on or about the structure and will wet down the structure and a 25 to 40 foot perimeter around the structure. The spray heads of the sprinkler system may provide a spray or a mist and are placed in locations on the structure that could harbor an ember, such as under a deck, under a shade structure, or decorative features or planters, in a gutter, etc. The system operates automatically as it is assumed that the structure's owner will be absent when fire danger is eminent. However, the system can be started manually, at the structure or remotely, should the need arise.

The hydro fire mitigation system of one embodiment employs a control system that communicates with the sprinkler system and receives data from at least one sensor. The sprinkler system is fed by a water tank that is preferably separate from the municipal or well water supply that normally feeds the structure. The control system is also in communication with the tank such that when fluid in the tank falls below a predetermined level, the control system will direct the tank to be filled with water obtained from a municipal water supply, a lake, a stream, a pool, a community water tank that serves plurality of dwellings or other buildings, a local well, etc. As alluded to above, the control system may be remotely operated or monitored by way of various offsite means such as mobile phones, smart phones, the internet, etc. It follows that the structure and surrounding areas may be remotely monitored (e.g., sensor readings assessed, property status monitored with cameras, etc.) using smart phones, the internet, etc. In some embodiments, the control system receives data from the National Weather Service, or other comparable data sources that track to progress of fires or adverse weather events, which helps the controller to be prepared for an approaching wildfire well before it is identified by the sensor. In some embodiments of the present invention, the sprinkler system employs selectively adjustable sprinkler heads that may be controlled automatically by the control system or manually by the user or fire department personnel. This manual sprinkler control may be achieved remotely.

In operation, sensors identify flames, changes in temperature, humidity, pressure, wind, solar radiation, soil moisture lightning, etc. When the sensors identify flames, a sudden predetermined rise in air temperature, or imminent fire danger, the control system will selectively or collectively operate the sprinkler system as described briefly above. The sprinkler system of one embodiment is activated when an infrared flame detector detects a flame from an approaching fire. Once the flame is detected, the control panel activates the sprinkler system to water the property. The sprinkler heads may also expel fire retardant mixed with the water being drawn from the storage tank. The sprinkler heads will wet a structure along with the surrounding landscape and sub-structures up to a 25' to 40' radius around the structure. When the water begins to empty from the storage tank and the stored water level falls below a full level sensor, the control panel will open an electric valve installed on the domestic water line or well that supplies water to the house to fill the storage tank. In one embodiment, the control panel directs the sprinklers to issue water or combination of water and fire retardant for a minimum cycle time of about 20 minutes. After the minimum cycle time has elapsed, water will continue to flow if a sensor detects flames or until the water storage tank is emptied. If the sensor(s) does not detect flames after the initial 20 minute cycle, the control panel will cease wetting and enter the safe mode with consists of cycles that pause wetting for 15 minutes, then wet for 3 minutes. These cycles will continue until the water storage tank is emptied, or for a total of 10 cycles.

In one process, the controller will allow filling of the water storage tank until the full level sensor in the tank is covered with water indicating that the water tank capacity is full. During a watering cycle, should the tank become empty, the controller will terminate watering until the filling of the tank covers the half level sensor. At this point the controller will pole the fire sensors. Should fire be detected, watering will immediately resume. If fire is not detected, the safe mode is activated as described above.

It is a further aspect of embodiments of the present invention to provide a self-contained hydro fire mitigation system. More specifically, one embodiment of the present invention includes a dedicated power supply that is not dependent of the municipal power source, and a water supply that is dependent on the municipal water source, other than for the filling of the water storage tank. Accordingly, the system life depends on the amount of water in the storage tank and the energy storage or generation capabilities of attached solar charging equipment employed by the system. The controller is always being powered by the system's battery bank. When municipal power is active, charging of the batteries is performed by the system's 120vac battery charger. If municipal power is shut off, the controller will draw upon backup power provided by batteries which are charged when required through attached solar charging equipment, thus allowing the controller to be powered and run theoretically indefinitely. If a system is equipped with a propane-powered generator, or a custom built backup solar power supply, the controller may activate one of these backup power sources upon an active fire event to provide power for such items as a home's water well pump. This aspect of the present invention may be important in a fire situation, because often municipal power and water supplies will be shut off or severely limited during a fire. The system of one embodiment of the present invention is functional for up to two weeks if utility power is shut off. If, however, solar power generation systems are employed, the system can theoretically run indefinitely. Further, if the tank is interconnected to a natural water supply or autonomous well, it can be automatically filled and, thus, the entire system can be run for many days if needed.

It is a related aspect of embodiments of the present invention to provide a hydro fire mitigation system that can be automatically initiated, because often during a fire the structure's owners are evacuated before the fire becomes an imminent danger. The controller will activate the sprinklers if the fire comes within a predetermined distance from the structure with no human intervention. The owner can set parameters to dictate when the hydro fire mitigation system will be activated. Alternatively, the system can be activated manually and remotely through a software application accessible by the owner's mobile device, a remote computer, etc. It is also contemplated that local fire authorities may be given access to the controller so they can activate the controller to initiate fluid flow to the sprinklers if necessary.

The components of one embodiment of the present invention are summarized in greater detail below.

Controller

The controller of one embodiment of the present invention communicates with at least one sensor. The sensor may be hardwired into the controller or rely on wireless communication systems known in the art. Those of ordinary skill the art will appreciate that the controller may also send collected data off-site, wherein controller functions and states are monitored, and/or commands are initiated by the owner or off-site personnel. The controller may communicate with the sensors in various ways and may employ redundant communication systems such that if a controller or sensor(s) is damaged or malfunctioning, the controller can be operated or the sprinkler system can be initiated using an off-site controller or software application. In the former situation, a remote computer or the user's mobile device functions as a mobile controller wherein the hydro fire mitigation system uses external communications systems that allow the remote device to communicate directly with the other system components. In one embodiment, the controller is customizable to meet the owner's needs. Further, some controllers can communicate with the sensors that monitor closed circuit television cameras, gates and access systems, attic fans, HVAC interfaces, area lighting, swimming pool pumps, motorized attic vents, etc.

The controller of one embodiment of the present invention has diagnostic capabilities and can monitor and assess the health of the system's main components, such as storage tank water level, sensor functionality, pump readiness, sprinkler system readiness, etc. If a component is not working properly, the owner is notified through an email, automated call or text, or through a notification application on their mobile device. Alternatively, the local fire department may be notified. Some embodiments of the present invention can "self heal," reboot, or reroute functionality to a redundant system to address a fault issue. Other embodiments of the present invention may run a system test initiated by the owner at the controller. This system test activates the sprinkler system and may inject a small amount of fire retardant.

Sensors

The sensors employed by one embodiment of the present invention are infrared and positioned at predetermined locations on or around the structure. The sensors of one embodiment can detect an adverse event at least up to 300 feet from the structure. In another embodiment, depending on the magnitude and intensity of a fire, the sensors may detect an adverse event further than 300 feet from the structure. To enhance capability, some embodiments of the present invention employ remote sensors positioned about the structure's perimeter to either notify the controller of a possible fire event or notify local fire to authorities of an impending event. The sensor inputs of the controller may be programmable for use with either latching or non-latching fire sensors.

Sprinkler System

The sprinkler system employed by some embodiments of the present invention utilizes known sprinkler head technology. The sprinkler system can compromise one or more sprinkler heads offset from the roof of the structure. The sprinkler heads may be located above the roof or extend laterally therefrom. When initiated, the sprinkler heads collectively and simultaneously expel fluid in a predetermined pattern a predetermined distance from the structure. Some sprinkler systems that may be used are automatically or remotely deployable such that when not in use they are concealed within the structure. Still other sprinkler systems that may be used can selectively direct fluid spray at an oncoming fire. That is, the sprinkler heads may be selectively activated moved by the controller using information from the sensors to precisely apply position the fluid spray to address the fire danger, which may help conserve the water supply. The sprinkler system is supplied with water from the storage tank pressurized by a booster pump. A booster pump may not be required if the pressure of the home's water source is sufficient to employ the sprinklers on the home. Other embodiments of the present invention employ sprinklers with water from the storage tank and water from the municipal water supply, if available. To prevent freezing, a manual or automatic drain valve may be employed.

Power System

The power system of one embodiment of the present invention is based on battery power. The batteries may be recharged using the structure's municipal power supply. In other embodiments of the present invention, the batteries are charged by solar power. To provide an autonomous system, the system is solely based on solar power. To insure the batteries remain charged, the control system may continuously or periodically monitor battery power consumption and charge level. Battery status information is sent to a user interface of the control system that allows the user to quickly assess the status of the hydro fire mitigation system. Some other embodiments of the present invention will actively notify the owner if system power level is below a predetermined threshold. Such notification may be forwarded to remote computer via email, for example, or to the owner's mobile communication device.

Water Source

The water supply of one embodiment of the present invention is not linked to or dependent upon the structure's municipal or local water supply. The system's water supply is a water storage tank that feeds water to the booster pump mentioned above, pressurizing the water before it is sent to the sprinkler system. Again, the hydro fire mitigation system's water supply is not connected to or dependent upon the structure's water supply which means reduced municipal water supply is not an issue. More specifically, connecting the sprinkler system to a structure's water supply restricts the number of sprinkler heads that can be used concurrently. And tying the sprinkler system to the municipal water supply is not ideal as water pressure may decrease in such a way to reduce sprinkler effectiveness. For example, a fire department will use a great amount of water during a fire, which will reduce pressure to the structure. This issue is addressed by providing an autonomous water supply. One embodiment of the present invention provides up to about 40 gallons per minute of water at about 70 psi to 2 to 26 sprinkler heads. Although it is desirable to have an autonomous water supply, those of ordinary skill in the art will appreciate that a storage tank may be employed that supplements the water supply and pressure of the municipal system. Storage tank would then be used if the normal water supply is restricted or shut off.

As mentioned above, the water supply of one embodiment of the present invention is interconnected to a storage tank and booster pump that allows the system to supply several sprinkler heads. Thus the pressurized fire mitigating fluid can increase the radius of protection around the structure. Booster pump function is initiated and controlled by the controller which initiates pumping and fluid flow rate. Power needed to operate the booster can be supplied from the batteries, an integrated solar power system, a gas powered generator, or a municipal power supply (if available).

The tank of one embodiment employs sensors to ensure a sufficient amount of water is stored. The tank sensors are interconnected to the controller and when the water stored in the tank reaches a predetermined level, the tank sensor will notify the controller to add water to the storage tank. Alternatively, the controller will open a valve connected to the municipal water supply, a well, a lake, a stream, a swimming pool, or any other water source to selectively fill the tank. This functionality may also be used during a fire where the storage tank is selectively filled by a water source.

Some embodiments of the present invention employ mechanisms within the storage tank to heat or circulate the stored water. Some embodiments of the present invention employ mechanisms within the hydro fire mitigation system to heat and circulate the stored water within the water tank and supply line from the tank to prevent freezing of the water during seasonal transitional times of the early spring and early fall. That is, it is foreseeable that the contemplated hydro fire mitigation system may be used in cold or mountainous areas where freezing is an issue. To prevent tank freezing, thereby adversely affecting fluid flow, the fluid within the tank may be continuously or semi-continuously agitated. Further, some embodiments of the present invention include a storage tank with heating elements powered by a solar system and controlled by the control panel to ensure that the water within the tank is maintained at a predetermined temperature. Water storage tanks of some embodiments employ a heater and water circulation pump interconnected to the municipal power supply. Should the municipal power supply be shut off and if the system employs a backup generator, the controller may start and run the backup generator to power the heater and the water circulation pump.

Fire Retardant

As briefly mentioned above, it is one aspect of embodiments of the present invention to provide a hydro fire mitigation system that uses a flame retardant. The flame retardant may be non-toxic, biodegradable, and based on live microbes. Thus the contemplated fire retardant is safe to animals and can be reactivated with water for up to 15 days after initial application. In operation, the fire retardant is stored in a container and is injected into the water supply before it enters the sprinkler system. The water within the tank remains clean and can be used for other purposes. As the fire retardant is biodegradable, it does not require cleanup after it is applied.

The Summary of the Invention is neither intended nor should it be construed as being representative of the full extent and scope of the present invention. That is, these and other aspects and advantages will be apparent from the disclosure of the invention(s) described herein. Further, the above-described embodiments, aspects, objectives, and configurations are neither complete nor exhaustive. As will be appreciated, other embodiments of the invention are possible using, alone or in combination, one or more of the features set forth above or described below. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description of the Invention and no limitation as to the scope of the present invention is intended by either the inclusion or non-inclusion of elements, components, etc. in this Summary of the Invention. Additional aspects of the present invention will become more readily apparent from the Detail Description, particularly when taken together with the drawings.

BRIEF DESCRIPTION OF THE DRAWINGS

The accompanying drawings, which are incorporated in and constitute a part of the specification, illustrate embodiments of the invention and together with the general description of the invention given above and the detailed description of the drawings given below, serve to explain the principles of these inventions.

Figure 1:
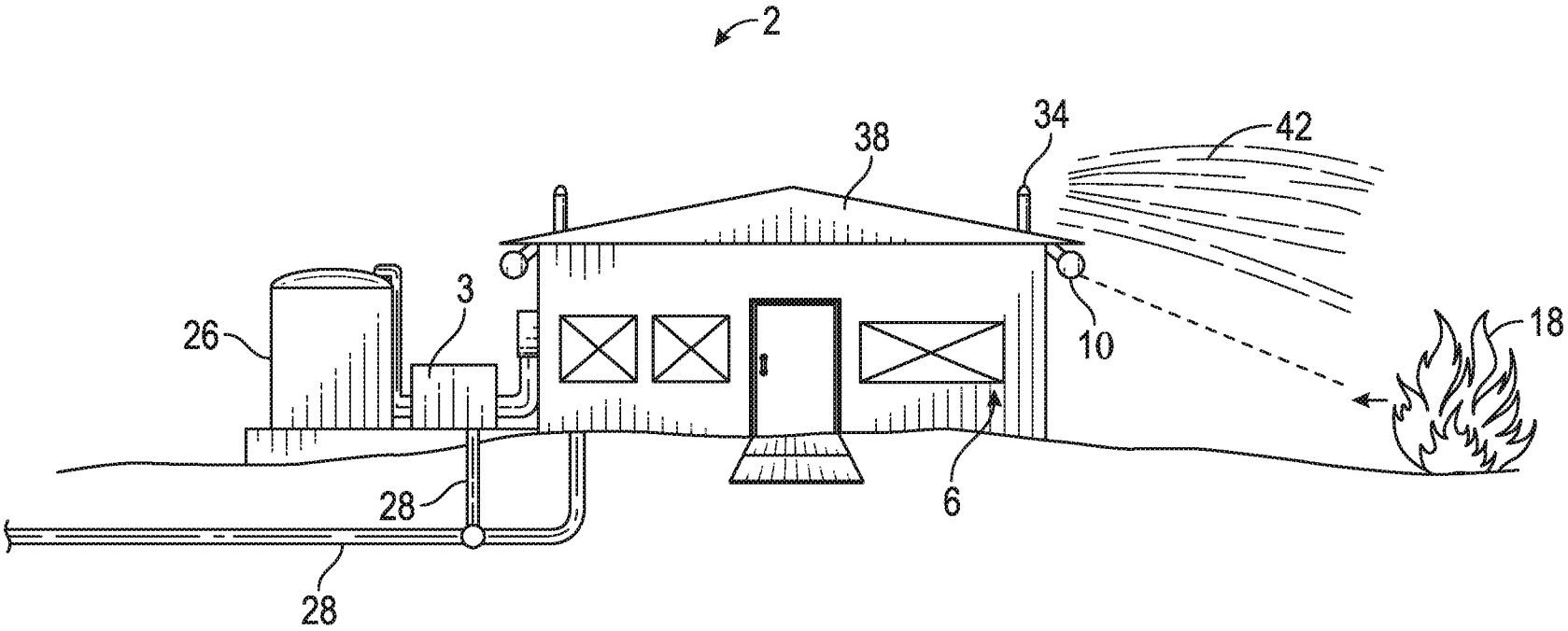
FIG. 1 is a representation of a hydro fire mitigation system of one embodiment of the present invention.

To assist in the understanding of one embodiment of the present invention the following list of components and associated numbering found in the drawings is provided herein:

| # | Component |
|---|---|
| 2 | Control Assembly Hydro fire mitigation system. |
| 3 | Powder coated aluminum enclosure |
| 6 | Structure |
| 10 | Sensor |
| 14 | Controller |
| 18 | Fire |
| 22 | Pump |
| 23 | Pump controller |
| 26 | Storage tank |
| 28 | Water supply |
| 30 | Fire retardant tank |
| 34 | Sprinkler (on the structure) |
| 38 | Roof |
| 42 | Fluid spray |
| 46 | Sprinklers (in ground) |
| 50 | Perimeter |
| 54 | Sensors |
| 58 | Injector valve |
| 62 | Motorized ball valve acting as a Gate valve |
| 66 | Fluid line |
| 69 | Water level sensor |
| 70 | Battery bank |
| 71 | Municipal power battery charger |
| 72 | Municipal power switch and outlet |
| 73 | Liquid level sensor wire hub |
| 74 | Inlet |
| 75 | Solar panels |
| 76 | Battery charge controller, 48 volts |
| 77 | Battery charge controller, 24 volts |
| 78 | Circuit breakers for solar and battery bank |
| 79 | Municipal power surge protector |
| 80 | 24vac transformer |
| 81 | 24vac inverter |
| 82 | Municipal power ground fault circuit breaker |
| 83 | Fireman's switch |
| 84 | Flow Switch |
| 100 | Communications Port #1; Two Wire RS-485. |
| 102 | Terminal blocks: Fire sensor ports for Normally Open sensors. |
| 103 | Auxiliary Power: provides starting for backup generator, or backup solar supply 120vac inverter. |
| 104 | 24vac Inv/Prop Valve: provides power to 24vac inverter, or Propane Valve for use with generator. |
| 105 | Communication Power: Provides power and control for communications equipment. |
| 106 | Tank Heater: Energizes power for water storage tank heater |
| 107 | Utility powered 24vac transformer power input |
| 108 | 24vac inverter power input |
| 109 | 24vdc power input |
| 110 | 24vdc fuse; 5.0 amp slow blow |
| 111 | Transformer 12vac fuse;1.6 amp slow blow |
| 112 | Transformer 24vac fuse; 1.6 amp slow blow |
| 113 | 24vac Inverter fuse; 1.6 amp slow blow |
| 114 | User input Switches |
| 115 | Tank Level LEDs: Indicate water level in tank |
| 116 | System LEDS; Indicate power type, output, input, alarm, fault, and sensors. |
| 117 | Status LED: Indicates particular operation modes or conditional states |
| 118 | 12vdc auxiliary power fuse; 1.5 amp slow blow |
| 119 | Communications Port #2; Two Wire RS-485/RS-232 |
| 120 | Communications Port #3; RS-232 |
| 121 | Auxiliary Output |
| 122 | Auxiliary Output Status LED |

-continued

| # | Component |
|---|---|
| 123 | Fireman's Switch input |
| 124 | Siren Output |
| 125 | Alarm Relay; Normally Open or Normally Closed contacts |
| 126 | Fault Relay; Normally Open or Normally Closed contacts |
| 127 | Outputs for Gate Valve, Pump, Fire Retardant Valve, Tank Fill Valve, Drain Valve, and tank water circulation pump |
| 128 | Sensor Inputs; Flow Switch, Tank Water Temperature, Water tank level sensors |
| 129 | Ground Rod Lug |
| 119 | Communications Port #2; Two Wire RS-485/RS-232 |
| 120 | Communications Port #3; RS-232 |
| 121 | Auxiliary Output |
| 122 | Auxiliary Output Status LED |
| 123 | Fireman's Switch input |
| 124 | Siren Output |
| 125 | Alarm Relay; Normally Open or Normally Closed contacts |
| 126 | Fault Relay; Normally Open or Normally Closed contacts |
| 127 | Outputs for Gate Valve, Pump, Fire Retardant Valve, Tank Fill Valve, Drain Valve, and tank water circulation pump. |
| 128 | Sensor Inputs; Flow Switch, Tank Water Temperature, Water tank level sensors |
| 129 | Ground Rod Lug |
| 200 | Remote keypad |
| 204 | User input switch |
| 208 | Status LED |
| 214 | System LED |
| 294 | Fill valve |
| 300 | Motorized ball valve acting as a drain valve |

It should be understood that the drawings are not necessarily to scale. In certain instances, details that are not necessary for an understanding of the invention or that render other details difficult to perceive may have been omitted. It should be understood, of course, that the invention is not necessarily limited to the particular embodiments illustrated herein.

DETAILED DESCRIPTION

FIG. 1 shows a general layout of the hydro fire mitigation system 2 of one embodiment of the present invention. A structure 6 has at least one infrared sensor 10 that communicates with a controller 14. The controller 14 receives information from the infrared sensor 10 when a fire 18 approaches the structure. When the sensors 10 indicate the fire 18 is within a predetermined distance from the structure 6, the controller 14 opens a valve and directs a pump 22 to draw water from a storage tank 26. The storage tank 26 may be interconnected to municipal water supply 28, a lake, a pond, a pool, etc. During normal operations the storage tank 26 provides an autonomous fluid supply to the system to provide protection from the oncoming fire 18. Fire retardant drawn from a separate fire retardant storage tank 30 may also be added to the fluid stream. Fluid, i.e., mixture of water and fire retardant, is then directed to sprinklers 34 on the roof 38 of the structure 6 that issue a fluid spray 42 toward the approaching fire 18.

Figure 2:
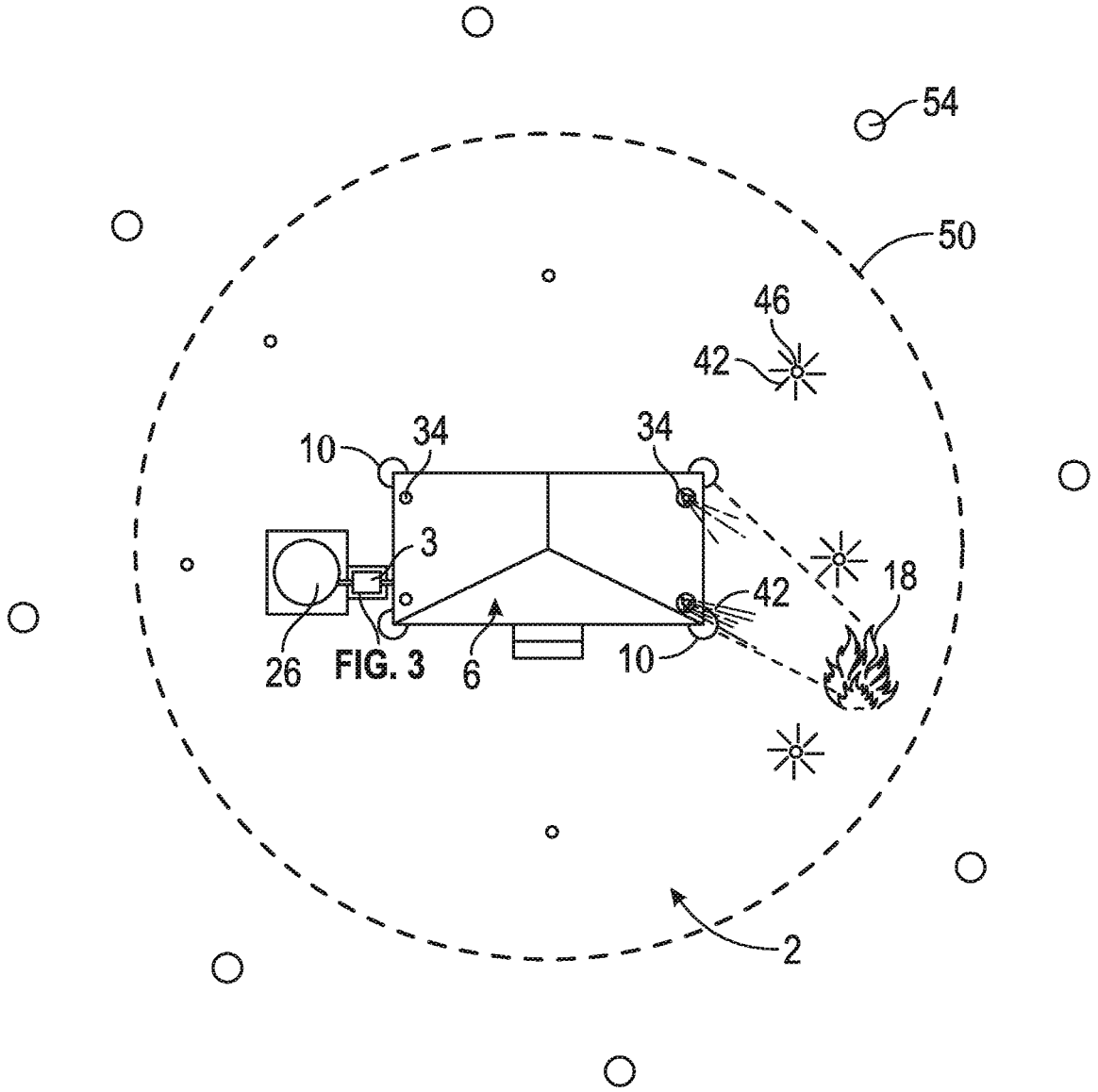
FIG. 2 is a representation of the hydro fire mitigation system of another embodiment of the present invention.

FIG. 2 is an aerial view showing the hydro fire mitigation system of another embodiment of the present invention. This embodiment is substantially similar to that shown in FIG. 1 and illustrates that other ground-based sprinklers 46 may help mitigate fire within or outside the normal fire protection perimeter 50 around the structure 6. The plurality of ground sprinklers 46 may also be associated with the storage tank 26 and be selectively activated by the controller 14. This version of the system provides protection from a fire from the ground and the air. Additional sensors 54 may be positioned about the perimeter 50 to help provide advanced fire warning. The advance warning helps the controller 14 quickly comes online to provide protection from combat the fire 18 before it enters the predetermined perimeter 50.

FIG. 2 also illustrates that the controller 14 of one embodiment of the present invention can selectively control direct water from the tank 26. More specifically, as opposed to energizing each rooftop sprinkler 34, the controller 14 can selectively direct fluid from the manifold (not shown) such that a precise fluid blast mitigates fire at a predetermined location. This helps prevent waste as issuing water from the sprinklers not near the fire may do little to help mitigate the fire.

Figure 3:
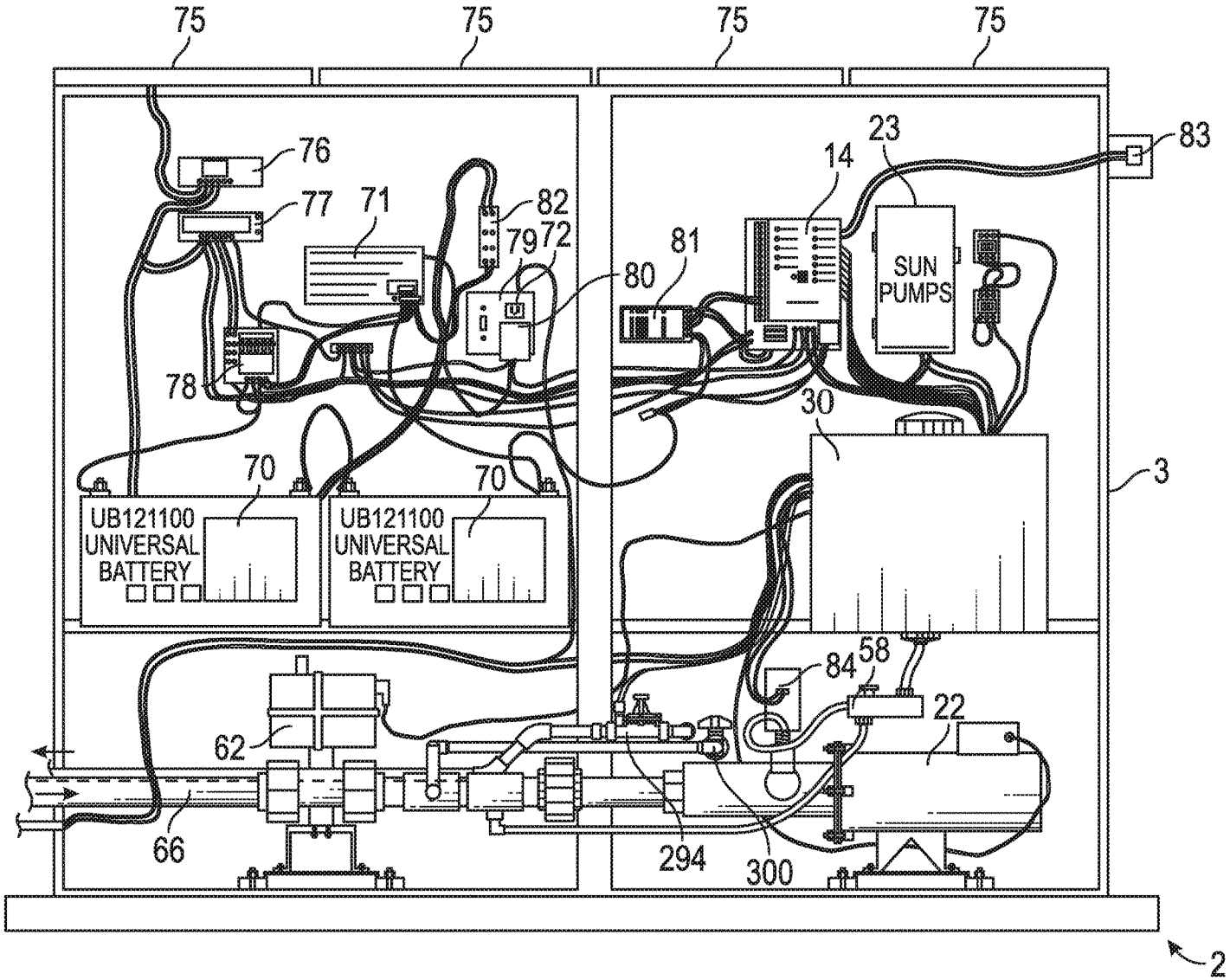
FIG. 3 is an elevation view showing components of one embodiment of the present invention.
Figure 4:
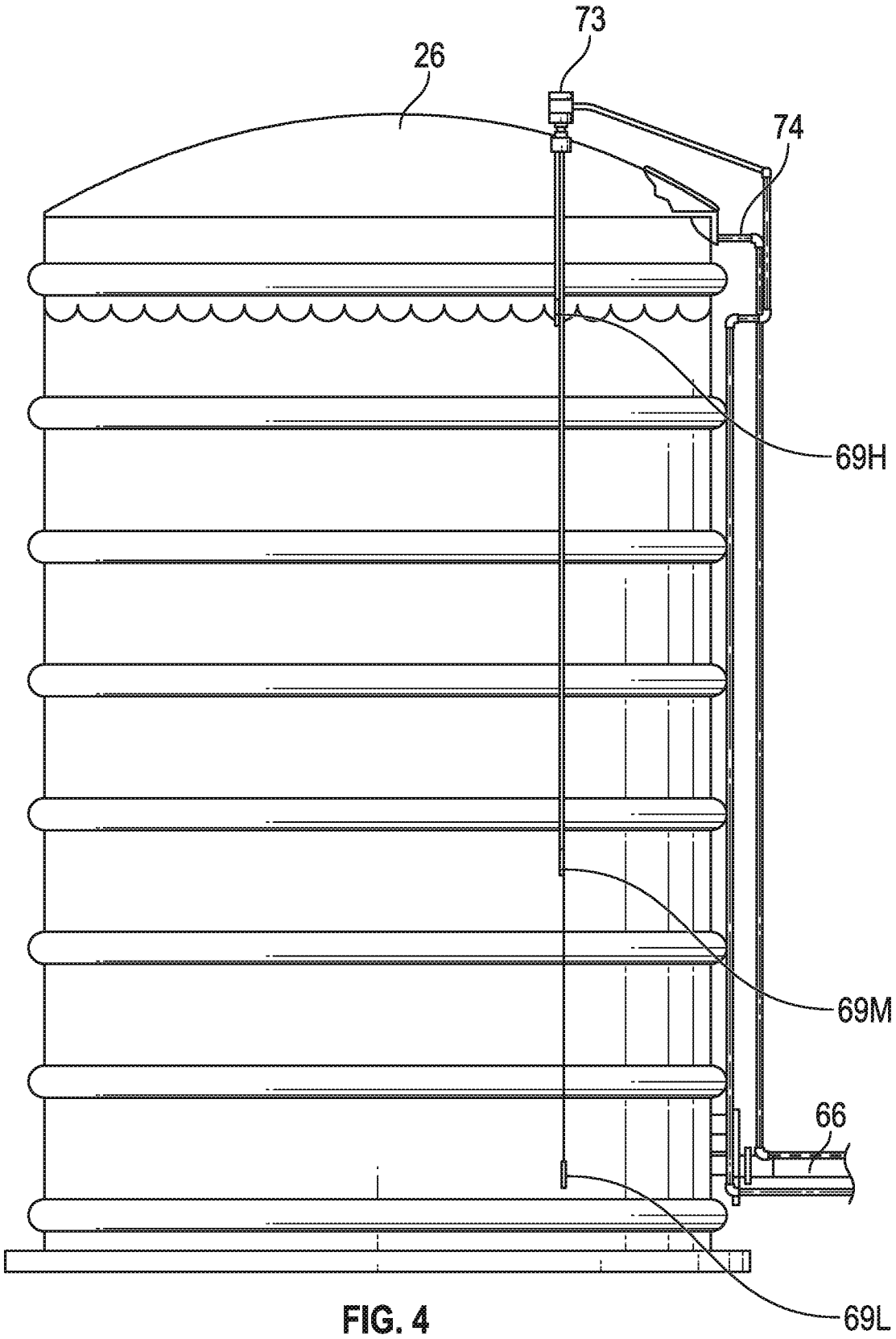
FIG. 4 is an elevation view showing a storage tank of one embodiment of the present invention.

FIGS. 3 and 4 show the hydro fire mitigation system 2 of one embodiment of the present invention. Those of ordinary skill the art will appreciate that the unit is self-contained, self-sustained, compact, and comprises controller 14 that communicates with various systems. When fire is detected, a motorized ball valve acting as a gate valve 62 associated with the storage tank 26 is opened and water enters a primary fluid line 66. The controller 14 also directs the flame retardant from a separate the flame retardant tank 30 to the fluid stream by opening injector valve 58 and the pump 22 (which may be controlled by a controller 23) pressurizes fluid mixture and sends it to the sprinkler system. The power needed for the components comes from a power source 70 comprising a plurality of batteries, which may be rechargeable or easily replaceable. The batteries are charged through one of two integrated battery charging systems. One system utilized while municipal power is available and active consists of battery charger 71, the power switch and outlet 72, the surge protector 79, ground fault circuit breaker 80 which is turn is interconnected to the municipal power source. The second or backup system operates when the municipal power is shut off consists of integrated solar panels 75, charge controllers 76 and 77, and circuit breakers and surge protector 78. An inverter may also be included that changes the direct-current taken from the batteries to alternating current to fit the power needs of the system. As shown in FIG. 4, the tank 26 is interconnected to the fluid line 66 and includes liquid level control sensors 69 in communication with the controller. The controller 14 receives fluid level 68 data from one or more sensors 69 to assess the high water level 69H, mid water level 69M, and low level 69L. The level sensors 69 are monitored by and interconnected to the controller 14. 73 that communicates with the controller. Water enters the tank 26 via an inlet 74.

Figure 5:
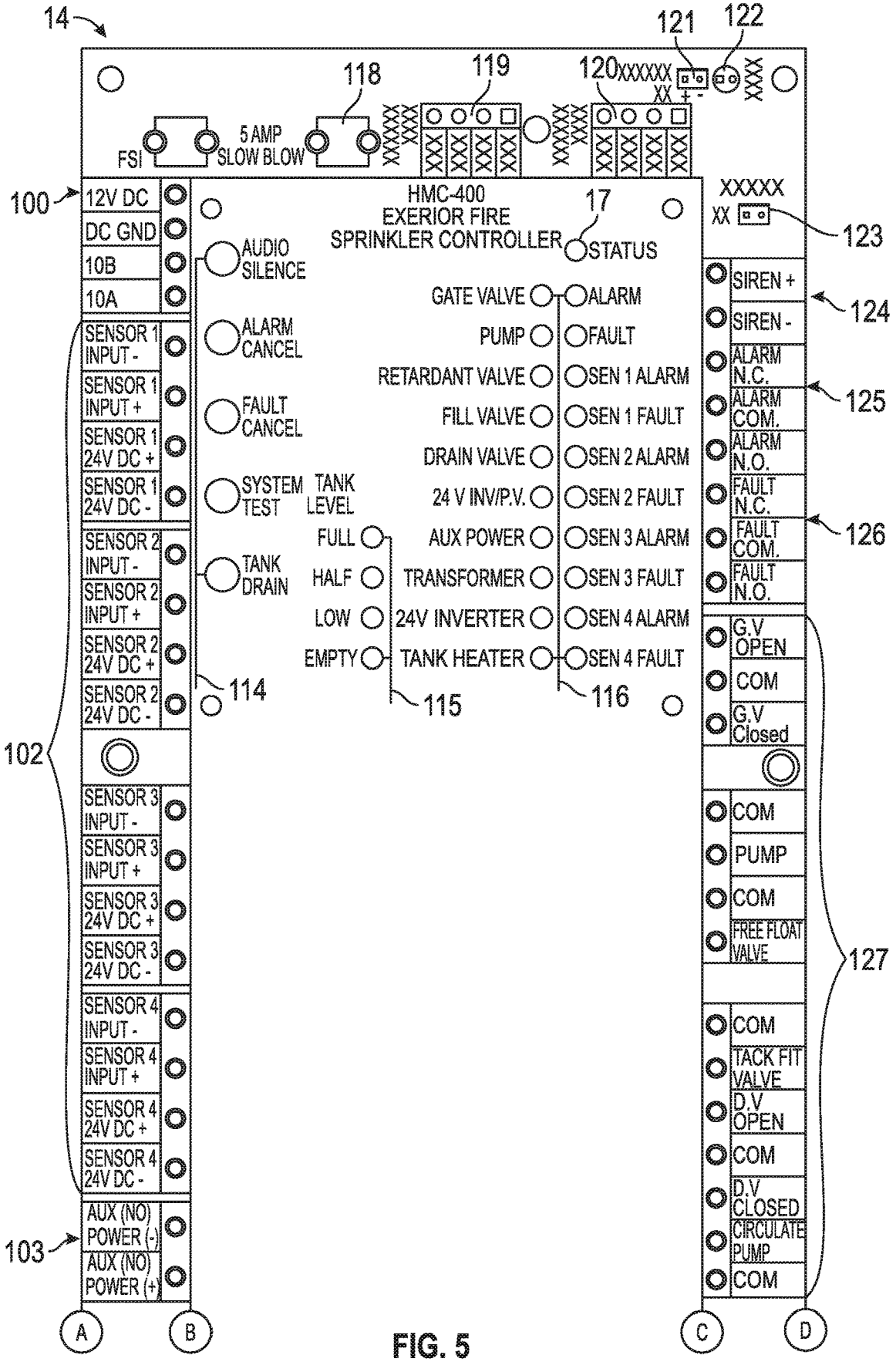
FIG. 5 is a representation of a controller of one embodiment present invention.
Figure 5:
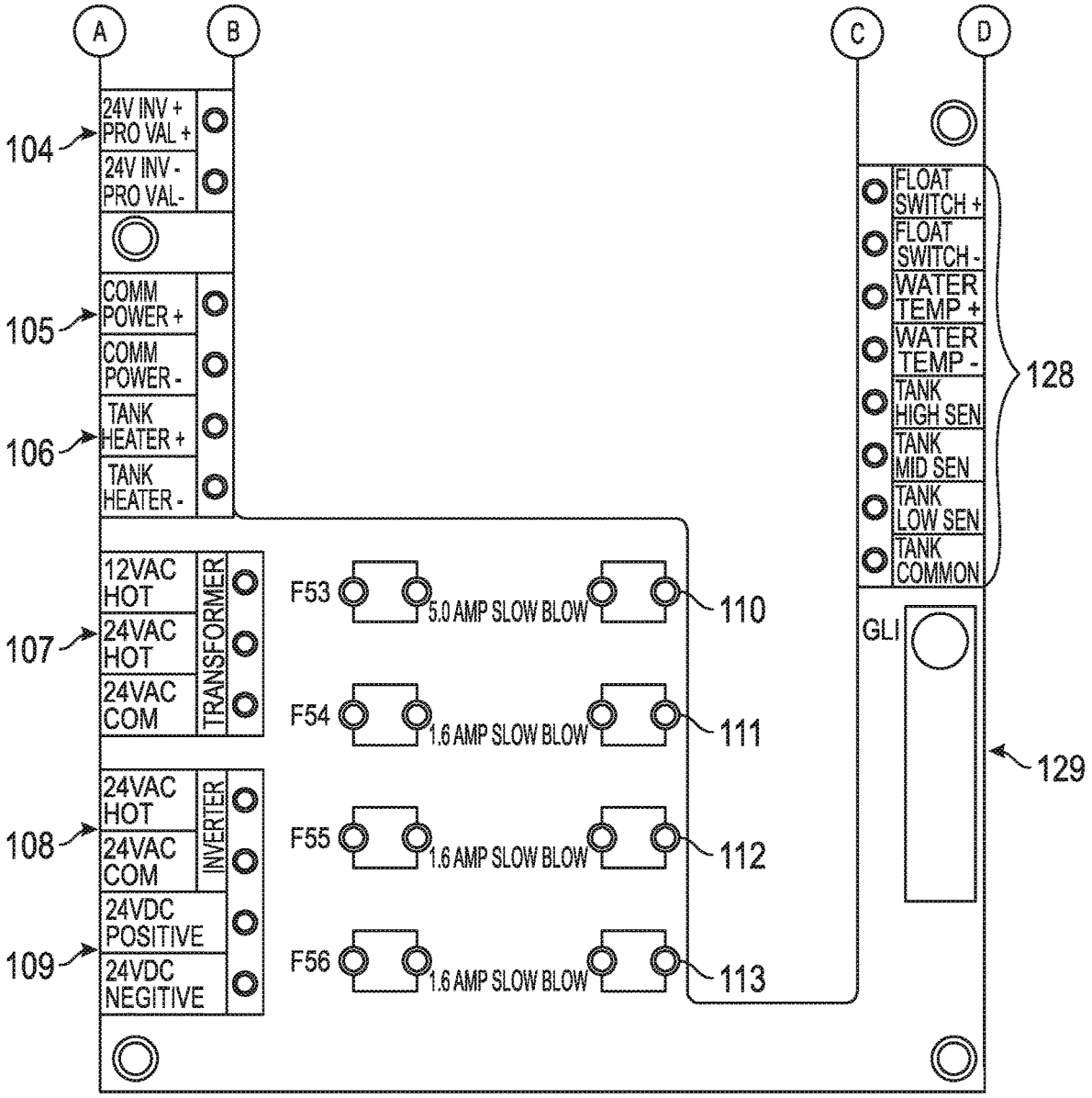

FIGS. 3 and 5 are illustrations of the self-contained, self-sustained hydro mitigation control system 2, and control panel 14 of one embodiment of the present invention, which includes one or more these features:

1) Powder coated aluminum enclosure 3;
2) Ground fault and power surge protected 120vac utility power 72, 79, 80;
3) Battery operated pump and controls 22, 14;
4) Battery charging through 120vac battery charger 71 and dedicated solar battery charger 75, 76, 77, 78;
5) At least four supervised sensor inputs for normally open fire detection sensors;
6) 24vdc power output for any fire sensors requiring power;
7) Audio and visual indicators for both system alarm and system fault conditions through LEDs, on board sounder, and optional 12vdc siren;
8) User input switches provide active user input to controller functions;
9) Remote wireless keypad for in home interaction with controller, up to 4 keypads per system;
10) Fireman's switch 83 providing a means of a precautionary 10 minute wetting cycle;
11) Water storage tank level control with automatic fill leak detection, and filling failure;
12) Control Valves: motorized ball valve acting as gate valve controls water flow into the pumping system; water storage tank fill solenoid electric valve controls the filling of the tank; fire retardant valve controls retardant flow to the injector: automatic motorized drain valve provides the means to drain the water storage tank and water lines;
13) Special programming for systems not requiring a water storage tank or a system that utilizes a multiuse water storage tank;
14) Pump controls that directly control pump or interface with special dedicated pump controller;
15) Pump operation verification upon alarm trigger and system test;
16) Water flow verification, via a flow switch 84, for systems not using a monitored water storage tank;
17) Twenty minute minimum wetting cycle;
18) Ten, three-minute Safe Mode cycles spaced fifteen minutes apart following wetting cycle;
19) Automatic system shut down when water storage tank is empty to protect pump;
20) If system is actively sensing fire when the tank empties, wetting functions will resume when water level reaches the half filled level sensor;
21) Suspend or disarm function: timed fire sensor lockout; maximum eight hours;
22) Roof cool function allows user to cool home or structure with 10 minute wetting cycle without fire retardant being used;
23) Panic button on remote keypad enables user emergency activation of the system;
24) Fault and error detection covering municipal power, fire sensors, fire sensor wiring circuits, environmental sensors, storage tank filing, storage tank leaking, non demand water flow, absence of on demand water flow, pump operations, backup power failure, low battery voltage, communications, and keypad communications.
25) Power type and source 24/7 monitoring enabling on demand power control;
26) Low power consumption when operating on battery power only;
27) Start and control interface with propane powered backup power generator or specially designed solar backup power supply;
28) Manual System Test function; timed feature maximum five minutes;
29) Tank and water line draining for maintenance and winterizing functions;
30) Optional function monitoring available through internet monitoring package (type of hardware package, wired or cellular will be case by case dependent), Wi-Fi compatible;
31) Optional voice over telephone alarm and fault monitoring capable; and 32) Alarm and Fault NC or NO relays provide contacts for interface with home fire or security systems.

The controller shown in FIG. 4 includes these features, some of which will be described in further detail below:

| # | Feature |
|---|---|
| 100 | Communications Port #1; Two Wire RS-485 |
| 102 | Terminal blocks: Fire sensor ports for Normally Open sensors |
| 103 | Auxiliary Power: provides starting for backup generator, or backup solar supply 120vac inverter |
| 104 | 24vac Inv/Prop Valve: provides power to 24vac inverter, or Propane Valve for use with generator |
| 105 | Communication Power: Provides power and control for communications equipment |
| 106 | Tank Heater: Energizes power for water storage tank heater |
| 107 | Utility powered 24vac transformer power input |
| 108 | 24vac inverter power input |
| 109 | 24vdc power input |
| 110 | 24vdc fuse; 5.0 amp slow blow |
| 111 | Transformer 12vac fuse; 1.6 amp slow blow |
| 112 | Transformer 24vac fuse; 1.6 amp slow blow |
| 113 | 24vac Inverter fuse; 1.6 amp slow blow |
| 114 | User input Switches |
| 115 | Tank Level LEDs: Indicate water level in tank |
| 116 | System LEDS; Indicate power type, output, input, alarm, fault, and sensors. |
| 117 | Status LED: Indicates particular operation modes or conditional states |
| 118 | 12vdc auxiliary power fuse; 1.5 amp slow blow |
| 119 | Communications Port #2; Two Wire RS-485/RS-232 |
| 120 | Communications Port #3; RS-232 |
| 121 | Auxiliary Output |
| 122 | Auxiliary Output Status LED |
| 123 | Fireman's Switch input |
| 124 | Siren Output |
| 125 | Alarm Relay; Normally Open or Normally Closed contacts |
| 126 | Fault Relay; Normally Open or Normally Closed contacts |
| 127 | Outputs for Gate Valve, Pump, Fire Retardant Valve, Tank Fill Valve, Drain Valve, and tank water circulation pump. |
| 128 | Sensor Inputs; Flow Switch, Tank Water Temperature, Water tank level sensors |
| 129 | Ground Rod Lug |

The controller 14 combines aspects of a fire annunciation and control panel, irrigation controller, pump controller, an electrical power monitor to automatically sense oncoming fires through infrared light detectors, and respond with precision water and fire retardant application. The control system is used with at least one storage tank, but may provide control for structures with adequate well flow, access to a pond, swimming pool, a community well, a community water storage structure, or a rainwater cistern. Further, the hydro fire mitigation system can use a multi-use water storage tank that can also be used for irrigation, home water, or reserve water.

Again, as articulated above, the controller is designated to be fully automatic to aid in the detection and mitigation of a wildfire through wetting a protected area with water or water/fire retardant mix. Upon power up, the controller does not require user initiation to enter various modes of operation including: 1) sentry (i.e., armed) mode; 2) general alarm mode; 3) general fault mode. Other various modes or functions require user interaction including: 4) suspend or disarm mode; 5) system test mode; 6) roof cool mode; 7) tank drain mode; and 8) winter mode.

In the sentry or armed mode the fire detection sensors review the property for fire which create alarm triggers. Also in the sentry mode, component health, such as sensor status, remote keypad communications, off-site communications, storage tank water level, and power status and source are monitored. Power status and source are constantly being monitored regardless of the mode the controller is executing. Municipal power is sensed through the 24vac transformer 81 and its corresponding input on the controller. Should municipal power fail, the batteries are monitored for their state or level of charge. If under battery power only and should an event arise that requires 24vac, the controller will activate the integrated 24vac inverter 82 and will monitor it's voltage level. Should an event arise that requires additional power and if the system employs such back up power equipment, then the controller may activate the employed back up power generator, or custom built solar power supply and 240vac/120vac inverter. Power status monitoring includes monitoring the battery state, wherein if the power provided by the municipality is below a certain level, a backup power source is used. If battery power is required, the controller will energize and the inverter will activate the backup power source. In sentry mode also allows the user may to change operational modes as desired upon request. The user can change these modes alter controller inputs through an integrated keyboard, an integrated remote keypad, a wireless computer, or mobile device. It follows that the controller may include direct connection mode using an internet interface that will maintain continual communication with a monitoring website so off-site personnel—fire department or the user—can confirm proper operation status of the controller.

If the sensors identify a fire threat, a general alarm mode is triggered. The general alarm mode may further include a protection mode (initial wetting cycle) and a safe mode (cyclic wetting). An alarm indicator (e.g., an LED) corresponding to the active sensor may be illuminated to indicate a "hot" sensor at the controller, remote keypad, and off-site communications device. The user may also be notified on their mobile device that the alarm has been triggered. After the alarm is triggered, the protection mode begins.

The protection mode may initiate a notification to fire protection personnel. More importantly, the gate valve associated with the storage tank is opened and the pump initiates controlled water flow. Water is then directed to the sprinkler heads, wherein such flow is monitored to ensure that it is delivered to the correct sprinkler heads. In some embodiments of the present invention, a 20 minute initial wetting cycle is commenced, at the conclusion of which the fire detection sensors are polled for continued fire danger. If fire danger is still detected, wetting will continue and every minute the sensors will be polled. If the sensors continue to detect fire, wetting will continue until either the tank empties or the sensors stop detecting fire danger.

If water in the storage tank is depleted, it can be replenished during this time and, once replenished to a predetermined level, wetting can resume. In a tank empty situation, the booster pump is shut off and the gate valve is closed. The storage tank will be replenished until water level reaches the mid level sensor 69M. If the water supply tank cannot be replenished, wetting stops and a completed alarm cycle (CAC) mode is initiated.

The safe mode provides a timed cycle wetting to help create an environment that prevents stray embers from igniting flammable materials. Again, this mode is initiated after the initial 20 minutes cycle after the initial fire threat is addressed. The safe mode turns on the sprinklers for 3 minutes, which is followed by a 15 minute pause. The cycle repeats until either the water in the storage tank has been depleted or when 10 wetting cycles are completed. The end of the safe mode initiates the CAC mode.

The CAC mode may employ visual or audible alarms to inform the user that the controller has completed the alarm cycle. The siren may sound for at least 5 seconds, every 20 minutes until the user presses and alarm cancel switch. The system has an automatic drain valve that opens for at least 3 minutes to allow for fluid to be drained.

Pump and Flow Monitoring

The controller of one embodiment of the present invention will monitor the system with a flow switch 84 to determine if water is flowing when it is supposed to. The controller also provides pump monitoring and will verify if the pump has run when the command has been sent. As soon as pump verification is initiated, the sequences described above are started. If water flow is not detected within the 60 seconds of pump initiation, the controller will attempt to get the water flowing. For example, the controller may open and close the motorized ball valve acting as the drain valve, close and open the motorized ball valve acting as a gate valve, and restart the pump for a predetermined amount of time. If water flows, the timing sequences described above will be started. If after multiple attempts to start the pump are unsuccessful, the controller will initiate a pump fault. The controller will repeat the above sequences until flow is detected or the user intervenes by pressing an alarm cancel switch. The controller will continue to monitor water flow to detect any malfunctions of the system which may cause the water to stop flowing. If water flow stops unexpectedly, a flow fault will be initiated, and the controller will work to regain flow through the means described above.

Tankless flow, which means pressurized water is being optimized from an alternative source and the booster pump is not being used, may also be monitored. As soon as water flow has been verified, timing sequences outlined above are started. If water flow is not detected within 60 seconds of the motorized ball valve acting as a gate valve being opened, the controller will attempt to initiate fluid flow by opening and closing the motorized ball valve acting as the drain valve, closing and opening the gate valve. If water flow is not detected at the end of the first attempt to get water flowing, the controller will continue to cycle opening and closing the gate valve repeat the above cycle until water is flow detected. If after multiple attempts to initiate fluid flow it is unsuccessful, a flow fault will be triggered and the sequences described above will continue to be executed.

If an unexpected water flow has been detected, the controller will attempt to shut down the flow by flushing the lines and motorized ball valves acting as a gate valve and drain valve through a timed opening and closing cycle, stopping the pump, and closing the gate valve. If the flow does not stop after the cycle, the controller will initiate an unexpected flow fault.

Storage Tank Monitoring

The water storage tank is constantly monitored through sensors in the water storage tank set for full, half, and low levels. These levels are displayed at the controller, the remote keypad, and an off-site communication device. To provide flexibility, the water storage tank may be used for additional purposes such as irrigation. During normal operations with utility power active (or if the system includes an auxiliary power system, e.g. generator or custom built solar power supply), the controller continuously checks the water level. If the drop in the water level is detected, a storage tank fill valve is opened to refill the tank to its full capacity.

A leak mode can also be activated to determine if there is a significant water leak. If the water level drops below the full water level sensor within a predetermined time period, a tank leak fault will be initiated. If, for example, the water level is maintained for a full 7 days, the leak mode is terminated. The controller fills a storage tank based on inputs from a filling timer. The timer durations are calculated based upon tank capacity and the volume of water the home can supply per minute. If the water level fails to cover an acceptable fill level sensor within the tank before the timer expires, a tank fill fault will be initiated.

During the general alarm mode the tank will be monitored to assess the need to refill. The pump will be damaged if the tank is empty, so when the water level falls below the full sensor level, a solenoid fill valve 294 is opened to begin refilling of the tank. When the water tank level falls below the low sensor, the tank is presumed empty, and the pump will be shut down, the motorized ball valve acting as a gate valve will be closed, and the motorized ball valve acting as the drain valve will be opened to drain the lines to maintain a dry system.

Fireman's Switch

Because owners are often evacuated before the fire danger is eminent, some embodiments employ an initiation switch 83 so a fireman can start a precautionary wetting cycle. Pressing the switch will start putting down water and fire retardant on the structure and surrounding area for 10 minutes. Of course, it is envisioned that the switch may be activated remotely by the user or the fire department personnel.

General Fault Mode

A general fault mode initiates when 1) there is an issue with a sensor; 2) the storage tank fails to fill properly; 3) there is a leak in the storage tank; 4) fluid flow is not detected during a general alarm or system test; 5) fluid flow is detected when not in the general mode or systems test; 6) the auxiliary power fails; 7) the battery charge is low; or 8) one or more communication systems fail. If a fault is detected, a fault LED associated with the controller may illuminate, or a notification the sent to an off-site communication device.

System Test Mode

The system of one embodiment allows the controller, hydraulic subsystem (the valves and booster pump), and the sprinkler system to be tested through the controller or remotely. The test results may be delivered through the controller. During the test, certain system functionality are initiated, such as the sprinkler system, valve operation, pump operation, fluid flow initiation, etc. Once the system test has concluded, the controller will automatically enter back into sentry mode.

Roof Cool Mode

One embodiment of the present invention allows the user to use the system to cool down the structure's roof and surrounding area. This mode is initiated through the user pressing and holding for five seconds the system test switch at the controller, or pressing the roof cool switch on the remote keypad. During this mode, the controller will open the gate valve and activate the pump for a timed cycle of 10 minutes. The execution of this mode does not inject fire retardant into the sprinkler system. Once the roof cool cycle has concluded, the controller will automatically enter back into sentry mode.

Suspend Mode

This mode is initiated when an alarm cancel switch of the controller or remote keypad is pressed during the sentry mode described above. When this mode is initiated, the controller becomes blind in that it will not respond to any fire sensor alarm inputs. This mode may also be timed so it will only be active for a predetermined time, e.g., 8 hours. The suspend mode can be cancelled any time within the 8 hour window by pressing an alarm cancel switch. After this mode is complete, the controller will automatically initiate the sentry mode.

Tank Drain or Valve Flush Mode

The controller may have a tank drain switch to either drain the storage tank, drain the sprinkler system lines and pump, or flush the primary motorized ball valves acting as a gate valve and drain valves. In one embodiment, the drain and flush mode is initiated by the user at the controller through the pressing of the tank drain switch or by an off-site communication device. This function may not be initiated through the controller's remote keypad. Once the controller determines the storage tank is empty, the valves will remain open for a predetermined amount of time so any water in the pump and main line will drain. At the conclusion of the predetermined time, the controller may enter a winterized mode.

Winter Mode

This mode drains the system to prevent freezing and is primarily for systems protecting structures in cold climates. After this mode is complete, the alarm can be triggered, but water will not flow. Further, most faults will remain active, except for tank, pump, and flow faults; the faults that pertain to water operations.

System Defaults Restore Mode

The system defaults restore mode resets all memory and system operating devices to their original values and states. This mode will restore normal operations should anything go wrong, and also brings the controller out of winter mode. Once the memory has been restored to its default state, the controller will go through its boot up sequence, then automatically enter into sentry mode.

Figure 6:
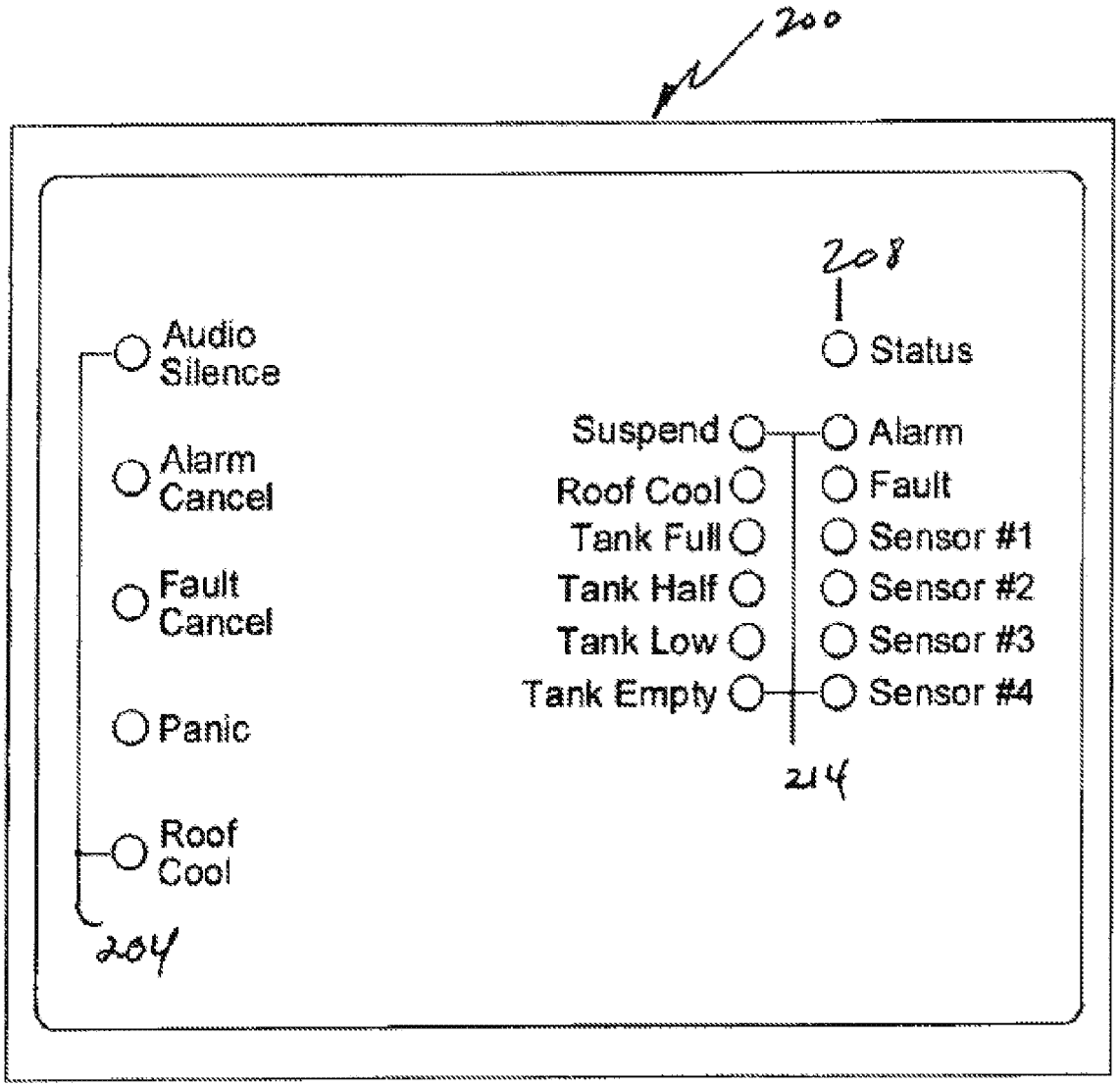
FIG. 6 is a representation schematic of a user interface of one embodiment of the present invention.

FIG. 6 shows the remote keypad 200 of one embodiment of the present invention. The keypad 200 includes user input switches 204, a status LED 208 that reflects controller status, and system LEDs 214 that reflect the status of some modes and states of the controller. The remote keypad 200 provides audio and visual indication of controller modes and status, and gives the user the ability to initiate some select features and functions. The LEDs may include: 1) suspend LED that illuminates when the system is in the suspend mode; 2) roof cool LED that illuminates when the sprinkler system is activated in roof cool mode; 3) tank LEDs that reflect the water level in the storage tank; 4) alarm LED the that illuminates when the general alarm mode is initiated; 5) fault LEDs that illuminate when in the general fault mode; 6) sensor #1-#4 LEDs that illuminate when a corresponding sensor is an alarm or fault state. The controller remote keypad has user input switches associated with: 1) audio silence; 2) alarm cancel; 3) fault cancel; 4) panic that initiates general alarm mode; and 5) roof cool that initiates roof cool mode the sprinkler system.

While various embodiments of the present invention have been described in detail, it is apparent that modifications and alterations of those embodiments will occur to those skilled in the art. It is to be expressly understood that such modifications and alterations are within the scope and spirit of the present invention, as set forth in the following claims. Further, it is to be understood that the invention(s) described herein is not limited in its application to the details of construction and the arrangement of components set forth in the preceding description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

What is claimed is:

1. A hydro fire mitigation system, comprising:

a connection to a water source;

a sprinkler system interconnected to the water source and having at least one sprinkler head positioned outside of a structure;

a controller in communication with the sprinkler system, the controller being operable to place the hydro fire mitigation system in at least three modes of operation comprising a sentry mode, an alarm mode, and a safe mode;

at least one fire detection sensor in communication with the controller, wherein the at least one fire detection sensor is spaced from the structure and configured to detect fire approaching the structure;

a tank for a fire retardant interconnected to the sprinkler system, wherein fluid expelled by the at least one sprinkler head selectively comprises either water, or a mixture of water and the fire retardant;

an injector valve connected to the tank for the fire retardant and being operable to inject fire retardant into a fluid line, the controller in communication with the injector valve;

wherein when the at least one fire detection sensor senses a fire, the controller activates the alarm mode and directs the sprinkler system to expel fluid in a predetermined area;

wherein the safe mode is initiated after the sprinkler system has expelled fluid during the alarm mode and fire is not detected by the at least one fire detection sensor; and wherein the fire retardant is injected into the fluid line prior to the fluid reaching a pump associated with the fluid line.

2. The system of claim 1, wherein in the alarm mode the controller provides a signal to a mobile device.

3. The system of claim 1, wherein in the alarm mode the controller directs the sprinkler system to expel fluid for a predetermined period of time, and wherein, after the predetermined period of time, if the at least one fire detection sensor does not sense fire, the controller activates the safe mode.

4. The system of claim 1, wherein, in the safe mode, the controller can periodically activate and deactivate the sprinkler system during a cycle, and wherein the safe mode continues for up to ten cycles.

5. The system of claim 1, wherein the sprinkler system is operable to be operated by a second controller.

6. The system of claim 1, wherein the controller is operable to direct the sprinkler system to expel the fluid when a fire is a predetermined distance from the structure, the predetermined distance set by a user.

7. A hydro fire mitigation system, comprising:

a connection to a water source;

a sprinkler system interconnected to the water source and having at least one sprinkler head positioned outside of a structure;

a controller in communication with the sprinkler system, the controller being operable to place the hydro fire mitigation system in at least four modes of operation comprising a sentry mode, an alarm mode, a safe mode, and a test mode;

at least one fire detection sensor in communication with the controller, wherein the at least one fire detection sensor is spaced from the structure and configured to detect fire approaching the structure;

a tank for a fire retardant interconnected to the sprinkler system, wherein fluid expelled by the at least one sprinkler head selectively comprises either water, or a mixture of water and the fire retardant;

an injector valve connected to the tank for the fire retardant and being operable to inject fire retardant into a fluid line, the controller in communication with the injector valve;

wherein when the at least one fire detection sensor senses a fire, the controller activates the alarm mode and directs the sprinkler system to expel fluid in a predetermined area;

wherein the safe mode is initiated after the sprinkler system has expelled fluid during the alarm mode and fire is not detected by the at least one fire detection sensor; and wherein the controller activates the test mode and directs the sprinkler system to expel water without the at least one fire detection sensor sensing fire.

8. A method of hydro fire mitigation, comprising:

providing a water source;

providing a sprinkler system interconnected to the water source and having at least one sprinkler head positioned outside of a structure;

providing a tank for a fire retardant interconnected to the sprinkler system, wherein fluid expelled by the at least one sprinkler head selectively comprises either water, or a mixture of water and the fire retardant;

providing a controller in communication with the sprinkler system and one or more of a valve, a pump, and a fluid-level sensor associated with the water source, wherein the controller is operable to place the sprinkler system in at least a sentry mode, an alarm mode, and a safe mode;

providing an injector valve connected to the tank for the fire retardant and configured to selectively inject the fire retardant into a fluid line;

providing a primary power source interconnected to the controller, wherein the primary power source is operable to receive power from a second power source;

providing at least one sensor in communication with the controller, wherein the at least one sensor is spaced from the structure and configured to detect fire approaching the structure;

detecting a fire at a predetermined distance from the structure when the sprinkler system is in the sentry mode;

initiating the alarm mode, wherein the controller directs all of the sprinkler heads within the sprinkler system to simultaneously expel fluid to a predetermined area when the fire is the predetermined distance from the structure;

initiating the safe mode after the sprinkler system has expelled fluid during the alarm mode and fire is not detected by the at least one sensor; and further comprising providing a switch located outside a system housing which causes the controller to place the sprinkler system in a fourth mode of operation, a wetting mode, in which the sprinkler system expels fluid comprising water from all the sprinkler heads simultaneously without the at least one sensor detecting fire.

9. The method of claim 8, wherein the at least one sprinkler head is interconnected to a roof portion of the structure and is operable to expel the fluid about an exterior of the structure.

10. The method of claim 8, wherein the at least one senor comprises an infrared flame detector.

11. The method of claim 8, further comprising polling the at least one sensor after expelling fluid for a predetermined period of time, wherein when fire is detected the controller directs the sprinkler system to expel the fluid for a second predetermined period of time.

12. The method of claim 11, further comprising initiating the safe mode when the at least one sensor does not detect fire after the predetermined period of time and expelling fluid periodically while the sprinkler system is in the safe mode, the safe mode including up to 10 cycles of activating and deactivating the sprinkler system.

13. The method of claim 8, wherein the injector valve is operable to inject the fire retardant into the water line based on a signal received from the controller.

14. The method of claim 8, wherein the controller is operable to sense and determine a status of the second power source, and wherein the controller is further operable to monitor a status of the primary power source when the second power source fails.

15. The system of claim 1, wherein the controller is in communication with one or more of a valve, the pump, and a fluid-level sensor associated with the water source.

16. The system of claim 1, further comprising a first power source interconnected to the hydro fire mitigation system, wherein the controller is operable to activate a second power source in the event that the first power source fails.

17. The system of claim 1, wherein the at least one fire detection sensor is operable to detect fire at least up to 300 feet from the structure.

18. The system of claim 7, wherein the fire retardant is injected into the fluid line prior to the fluid reaching a pump associated with the fluid line.

19. The system of claim 7, wherein the controller is operable to direct the sprinkler system to expel the fluid when a fire is a predetermined distance from the structure, the predetermined distance set by a user.

20. The system of claim 7, wherein in the alarm mode:

the controller provides a signal to a mobile device; and the controller directs the sprinkler system to expel fluid for a predetermined period of time, and wherein, after the predetermined period of time, if the at least one fire detection sensor does not sense fire, the controller activates the safe mode.

* * * * *